United States Patent [19]

Nordstrom et al.

[11] 4,225,282

[45] Sep. 30, 1980

[54] BACKHOE BOOM TRANSPORT LOCKING MEANS

[75] Inventors: Walter A. Nordstrom, Troy, Mich.; Bruno Brilts, deceased, late of Royal Oak, Mich., by Nina Brilts, heir; by Rasma Dumoulin, heir, Royal Oak, Mich.

[73] Assignee: Ford Motor Company, Dearborn, Mich.

[21] Appl. No.: 918,910

[22] Filed: Jun. 26, 1978

[51] Int. Cl.[3] ..... B66F 9/00

[52] U.S. Cl. ..... 414/694

[58] Field of Search ..... 212/66, 144; 414/680, 414/682, 735, 738, 694, 695, 722, 723, 724, 727, 741, 740, 717, 739, 687, 688, 689, 690, 691, 692, 693, 744, 550

[56] References Cited

U.S. PATENT DOCUMENTS

| | | | |
|---|---|---|---|
| 3,792,778 | 2/1974 | Sholl et al. | 212/144 X |
| 3,811,582 | 5/1974 | Shumaker et al. . | |
| 3,921,835 | 11/1975 | Baker et al. . | |
| 3,995,761 | 12/1976 | Hurlburt . | |

*Primary Examiner*—Frank E. Werner

*Attorney, Agent, or Firm*—John J. Roethel; Keith L. Zerschling

[57] ABSTRACT

A locking system for mechanically locking a backhoe boom in a transport position on an earth moving machine. The boom is supported for swinging movement about a horizontal pivot carried on a swing post coupled by a vertical pivot to a frame structure of the earth moving machine. The locking system comprises a lever fulcrummed intermediate its ends on the swing post. The lever has at one of its ends a latching element engageable with the boom in a raised position of the latter to prevent downward swinging movement, and at the other of its ends a latching element simultaneously engageable with the frame structure to hold the swing post and thereby the boom in a centered position. A manipulable actuator accessible at the operator's station is provided for actuating or releasing the boom locking actuator.

4 Claims, 4 Drawing Figures

BACKHOE BOOM TRANSPORT LOCKING MEANS

BACKGROUND OF THE INVENTION

A conventional backhoe mounted on an earth moving machine has an articulated boom that is pivotally mounted for swinging movement about a horizontal pivot means carried on a swing post coupled by a vertical pivot means to a frame structure of the earth moving machine. The raising and lowering movement of the boom and the side swinging movement of the swing post, and thereby of the boom, are actuated by hydraulic rams or cylinder mechanisms. During transport of the earth moving machine from one place to another, either under its own power or on a flatbed truck, the boom is hydraulically raised to prevent the earth digging bucket mounted on the free end of the boom from dragging on the ground. The swing post, and thereby the boom, are centered relative to the frame structure of the earth moving machine to avoid increasing the effective width of the earth moving machine or overhanging the sides of the flatbed truck on which the latter is being carried.

It has been found, however, that because of internal hydraulic oil leakage in the hydraulic position rams, the boom has a tendency to droop causing the bucket to drag on the ground or to drag on the truck bed or loading ramps as the machine is being moved on or off the truck bed.

Also, because of internal hydraulic oil leakage, the swing post has a tendency to permit the boom and its bucket to swing from side to side as the earth moving machine is driven down the road or is carried on the flatbed truck. This side to side swaying effect of the swing post and the boom, if permitted to attain any degree of magnitude, can result in steering instability of the earth moving machine or of the transporting vehicle.

Prior art patents, of which we are aware, have directed themselves primarily to the problem of maintaining the boom in a locked raised position. Devices limited to locking the boom in a raised position are disclosed in U.S. Pat. No. 3,811,582 issued May 21, 1974 to John F. Shumaker et al for a "Backhoe Boom Lock"; U.S. Pat. No. 3,921,835 issued Nov. 25, 1975 to Donald C. Baker et al for a "Releasable Lock Means for Boom"; and U.S. Pat. No. 3,995,761 issued Dec. 7, 1976 to Joseph C. Hurlburt for "Anti Lowering Device for a Boom Loader."

It is also known in the prior art, to use chains to restrict the movement of the boom and also of the swing post. In lieu of the chains, it is also known to use pins which may be inserted through aligned apertures in the boom and supporting frame structure to hold the boom in transport position. The difficulty with both the chains and the pins is that the loose sections of chain and the loose pins are frequently misplaced or deliberately not used. Frequently, the operator does not bother to lock the swing post and the boom when he has to move the earth moving machine only a few hundred meters from one place on the job to another, although the terrain over which he must traverse may be extremely rough. As a result, the operator finds his boom swinging from side to side and the bucket dragging on the ground, both of which can create steering instability that could result in an accident.

It is an object of the present invention to provide a boom locking means that is easily accessible to the operator from his station and which simultaneously mechanically locks the boom against lowering movement from a fully raised position and also the swing post and thereby the boom against swinging movement from side to side.

SUMMARY OF THE INVENTION

This invention relates to a locking means for mechanically locking a backhoe boom in a transport position on an earth moving machine. The earth moving machine is of the type in which the boom is supported for swinging movement about a horizontal pivot means carried on a swing post coupled by a vertical pivot means to a frame structure of the earth moving machine.

The locking means comprises a lever means fulcrummed intermediate its ends on the swing post. The lever means has at one of its ends a latching element engageable with the boom in a raised position of the latter to prevent downward swinging movement and at the other of its ends a latching element simultaneously engageable with the frame structure to hold the swing post and thereby the boom in a centered position.

A manipulable means is accessible at the operator's station for actuating or releasing the locking means.

DESCRIPTION OF THE DRAWINGS

The invention will be described by way of example with reference to the drawings in which.

DETAILED DESCRIPTION OF THE INVENTION

Figure 1:
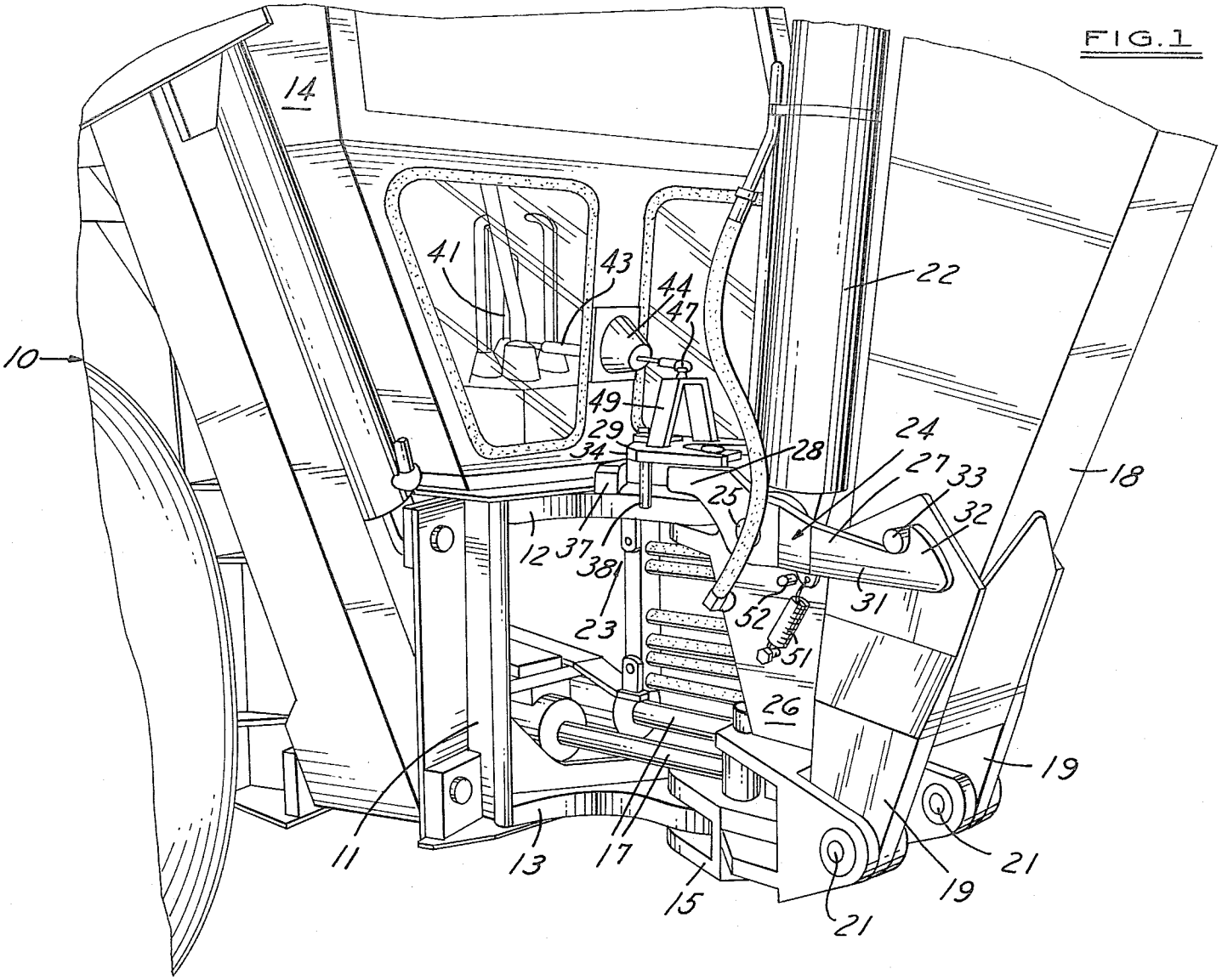
FIG. 1 is a perspective view of a portion of an earth moving machine having a locking means for locking the backhoe boom in a transport position according to the invention.
Figure 2:
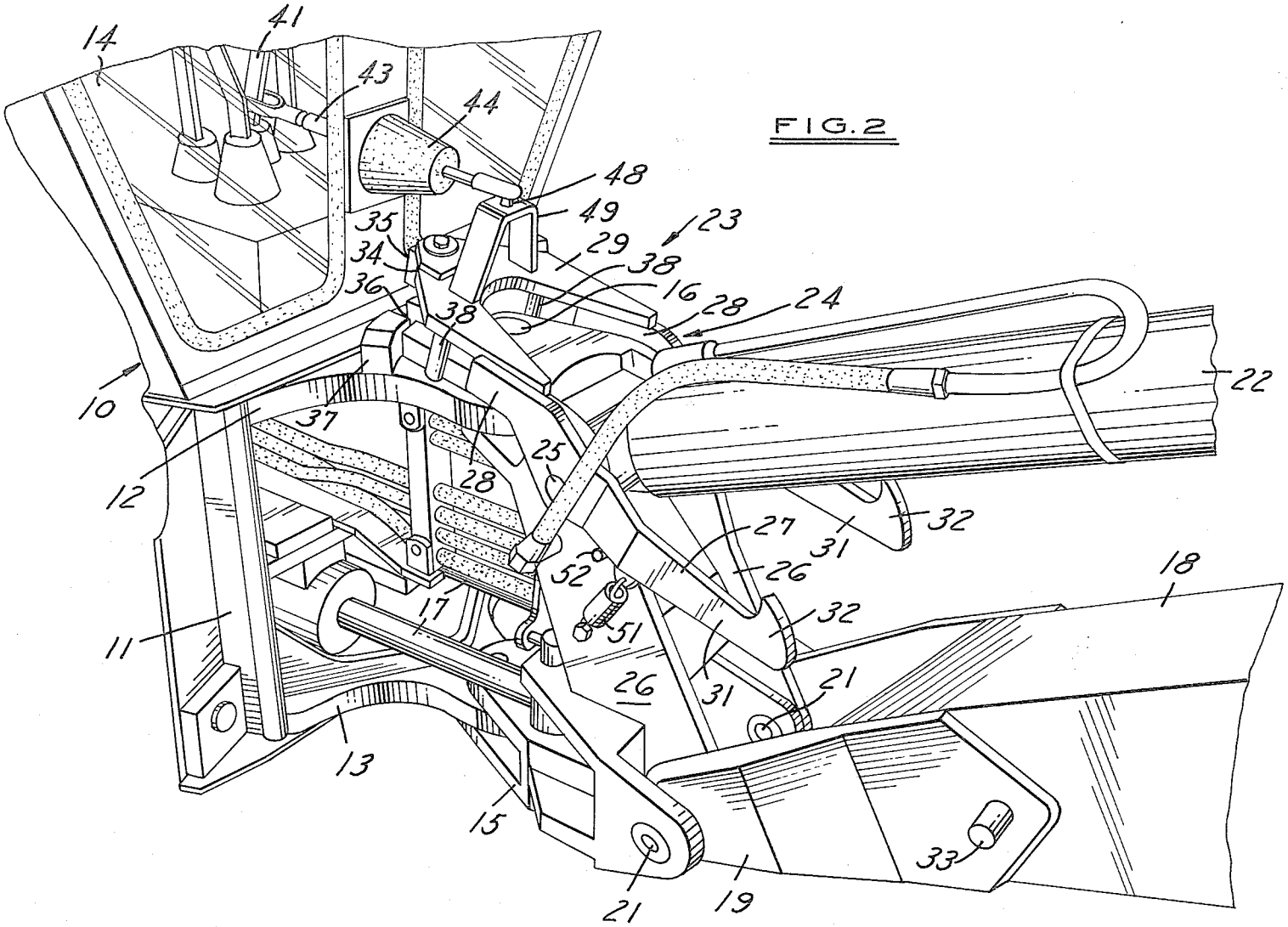
FIG. 2 is a view in part similar to FIG. 1 in which the locking means is shown in a non-locking position.

Referring now to the drawings, and more particularly to FIGS. 1 and 2, there is partially shown one end of an earth moving machine, generally designated 10, having an earth working implement or backhoe (not shown) mounted thereon.

Reference may be made to U.S. Pat. No. 3,811,582 for a typical backhoe arrangement to which the present invention readily would be adaptable. The earth moving machine 10 has an end frame structure 11 having upper and lower horizontal flanges 12 and 13 extending forwardly of the vehicle operator's cab 14.

Figure 3:
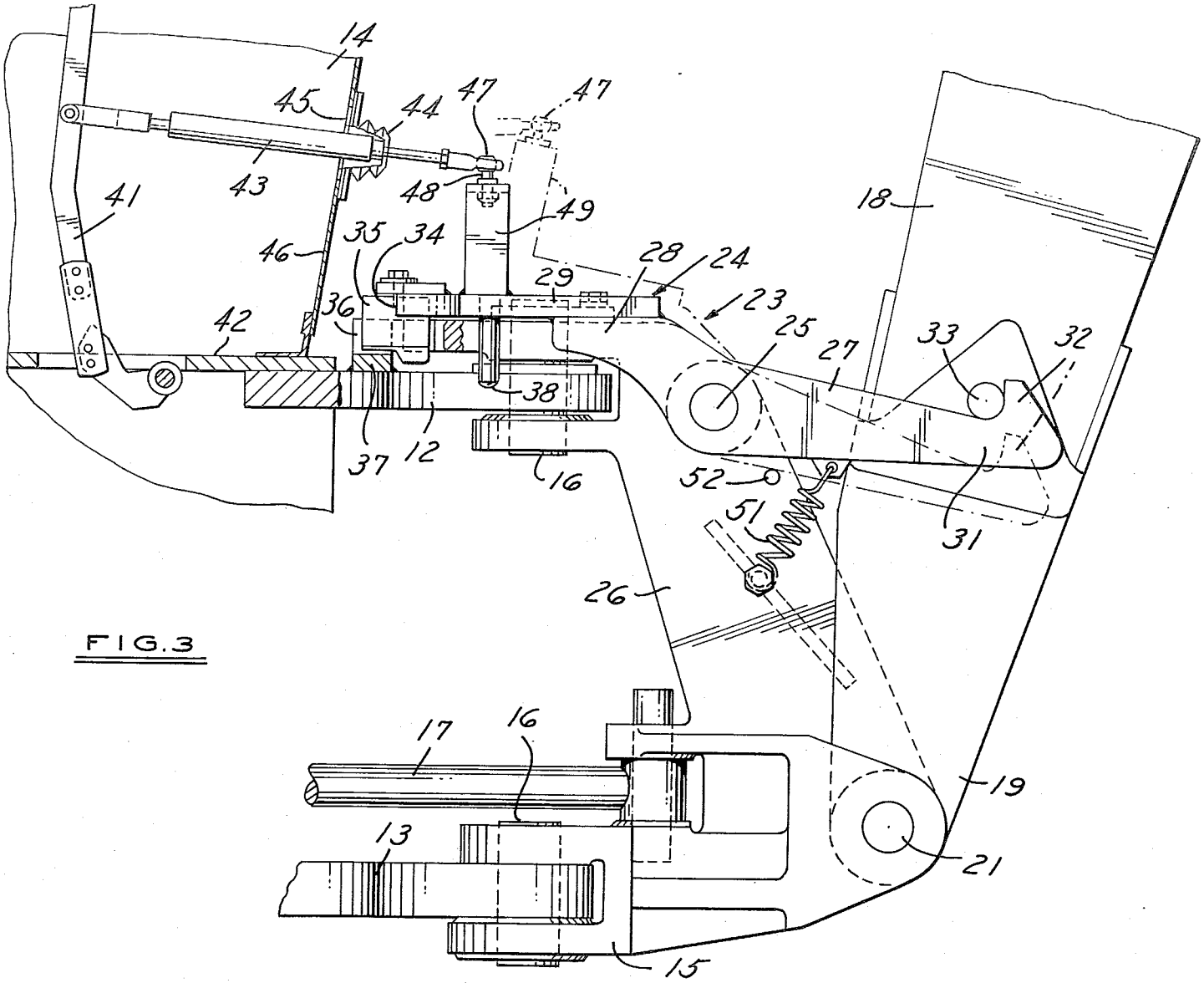
FIG. 3 is a side view, in part sectional, of the boom locking mechanism.
Figure 4:
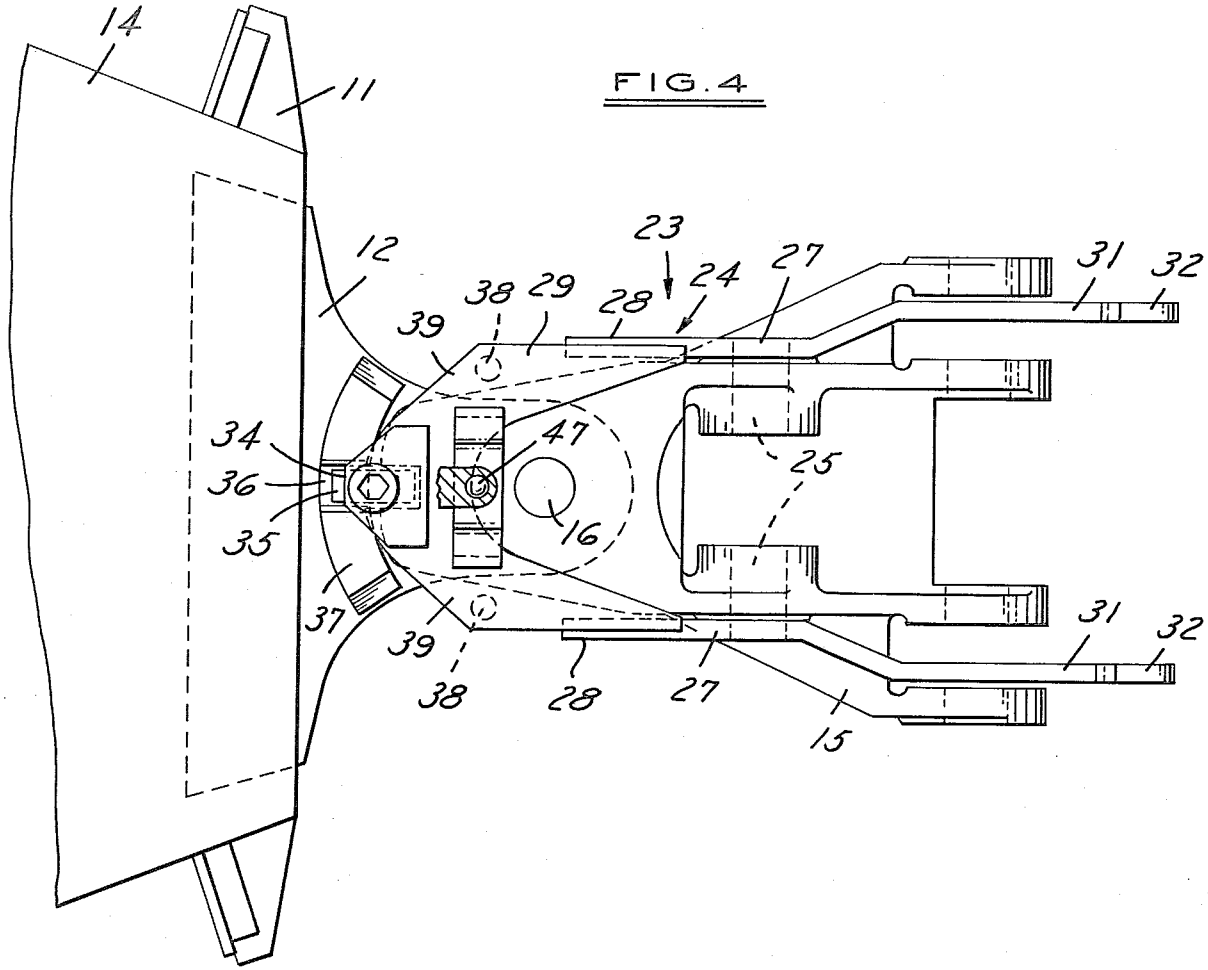
FIG. 4 is a top view of the mechanism shown in FIG. 3.

A swing post or support 15 is pivotally mounted on flanges 12 and 13 on pivot shafts 16, as best seen in FIG. 3. The pivot shafts 16 are vertically aligned to provide a vertical pivot axis about which the swing post 15 is horizontally swingable from side to side as may be required for bucket loading and unloading operations. The swing post 15 is swingable in either direction by a pair of hydraulic rams 17 located beneath the operator's cab on each side of the swing post pivot axis.

A boom 18 is supported at its inner or lower end 19 on horizontally aligned pivot pins 21 journalled in the swing post 15. The boom is swingable from a fully raised position, as shown in FIG. 1, to a lowered position, as shown in FIG. 2, by a hydraulic ram 22.

The backhoe support structure and actuating mechanism that has been described is conventional. Although the hydraulic rams 17 are capable of positioning the swing post 15 and thereby the boom 18 centrally of the earth moving machine, it has been found that internal hydraulic leakage in the hydraulic ram system will permit the swing post and therefore the boom to sway from side to side as the earth moving machine is driven or transported from one work location to another. Internal hydraulic leakage in the hydraulic system for the hydraulic ram 22 also affects the ability of the latter to maintain the boom 18 in the upright position shown in FIG. 1.

In accordance with the present invention, a locking means, generally designated 23, is provided to mechanically lock the swing post and the boom in the transport position shown in FIG. 1. The locking means 23 comprises an elongated lever 24 fulcrummed intermediate its ends on pivot pins 25 journalled in upstanding structural members 26 of the swing post 15. The pivot axis defined by the pins 25 substantially parallels the pivot axis defined by the pivot pins 21 about which the boom is swingable. The lever 24 is of bifurcated construction having spaced side arms 27 that are joined at their ends 28 closest to the swing post support frame 11 by a plate 29. The arms 27 on the boom side of the pivot axis 25 are spaced apart sufficiently to straddle the boom when the latter is in fully raised position, as shown in FIG. 1. The ends 31 of the arms 27 furthest away from the swing post support frame 11 have upwardly turned hooks 32 adapted to engage laterally extending pins 33 on the sides of the boom 18 to mechanically hold the boom in an upstanding position.

The lever 24 at its end 34 closest to the support frame 11 supporting the swing post 15 has a solid block or locking key 35 bolted to the underside of the plate 29. The key 35 is adapted to engage the walls of a slot 36 in an arcuate cam block 37 welded to the top of the support frame flange 12. The slot 36 straddles and extends longitudinally of the earth moving machine longitudinal center line. The key 35 simultaneously is seated in the slot 36 when the hooks 32 engage the pins 33 on the sides of the boom. When the key 35 is seated between the walls of the slot 36, the swing post 15 and thereby the boom 18 is held against swinging movement about the swing post vertical axis, as defined by the pivot shaft 16. The holding action of the key 35 may be reinforced by a pair of pins 38 depending from overhanging marginal sides 39 of the plate 29, the pins 38 being respectively engageable with opposite edges of the upper flange 12 of support frame 11 when the locking means 23 is in locking position.

As shown in FIG. 1, the hooks 32 on the ends of the lever arms 27 are engaged with the pins 33 on the boom 18 to hold the latter in an upstanding position. The key 35 is seated within the slot 36 of the cam block 37 mounted on top of the support frame flange 12 to lock the swing post 15 against swinging movement relative to its support frame 11. Thus, the boom 18 simultaneously is locked against swinging movement in an up and down direction and from side to side. It it is desired to release the swing post 15 and the boom 18 for operating movements, it is necessary to tilt the lever 24 in a clockwise direction about the pivot axis 25, as viewed in the drawings. Such tilting movement results in the hooks 32 being dropped out of engagement with the pins 33 and the key 35 being lifted out of the slot 36 in the cam block 37. The operator may do this by pivotally swinging an operating lever 41 pivotally mounted in the cab floor 42 in a clockwise direction, as viewed in the drawings.

The lever 41 is coupled to the locking means 23 by an extendible link assembly 43 that projects through a sealing boot 44 covering an aperture 45 in the front wall 46 of the cab 14. The extendible link assembly 43 has a ball and socket connection with a ball 47 carried on a stud 48 bolted to the upper surface of a bridge 49 which is welded to the upper surface of the lever plate 29. The push force applied to the lever 41 results in the locking means lever 24 being swung, as shown in FIG. 3, from the solid outline position to the dotted line position in which the swing post 15 and boom 18 are released for movement into the position as shown in FIG. 2.

Movement of the locking means lever 24 in a releasing direction may be assisted by a tension spring 51 extending from the lever arm 27 to an anchor on the swing post structural member 26. A stop pin 52 projects from the side of the structural member 26 to limit the downward movement of the lever arm 27. There may be a tension spring 51 on each side of the boom 18.

In released position of the locking means 23, the center of the ball 47 lies in a neutral position with respect to the pivot axis of the swing post. As best seen in FIG. 3, this neutral position is on the longitudinal pivot axis of the pivot shafts 16. In this neutral position, there are no lateral forces exerted on the extendible link 43 that would tend to bend the latter laterally relative to its longitudinal axis. It is not important that the center of the ball 47 lie on the swing post pivot axis when the locking means 23 is in swing post and boom locking position, since there can be no relative movement between the swing post and its support frame at this time.

The reason that the extendible link 43 must be an extendible assembly, that is, one in which the extendible rod is spring loaded in a retracting direction, is that the earth moving machine operator may attempt to place the control lever 41 in locking position at a time when the locking means 23 is blocked against entry into the cam block slot 36 because the key 35 is not in proper alignment with the slot or if the hooks 32 are placed in pin engaging position before the boom is raised so that the pins are in position to be engaged by the hooks. If either condition existed and if the link were a rigid link, the link could be subject to damage particularly as the massive weight of the boom engages the ends of the hooks 32. With an extendible link having a spring loaded rod, the hook arms would yield as the pins 33 ride over the inclined end surfaces of the hooks 32 until the hooks were in proper alignment with the pins.

Similarly, the spring force tending to retract the extendible link assembly rod into the link assembly housing would cause the key 35 to drop into the slot 36 in the cam block 37 as soon as the two were properly aligned.

It is to be understood this invention is not limited to the exact construction illustrated and described above, but that various changes and modifications may be made without departing from the spirit and scope of the invention as defined by the following claims.

We claim:

1. A locking means for mechanically locking a backhoe boom in a transport position on an earthmoving machine, the boom being supported for swinging movement about a horizontal pivot means carried on a swing post that is coupled by a vertical pivot means to a frame means of the earthmoving machine, the locking means comprising a lever means fulcrummed intermediate its ends on the swing post, the lever means at one of its ends and the boom having a first coacting lever means engageable in raised position of the boom for holding the latter in a raised transport position, the lever means at its other end overlying the frame means, the frame means and overlying lever means end having a second coacting latch means comprising a depending key on the overlying lever means and engageable with a slotted cam block mounted on the swing post support frame, the depending key being positionable within a slot in the cam block when the swing post is centrally positioned on its support frame, the depending key and slotted cam block coacting to hold the swing post and thereby the boom against swinging movement about the swing post vertical axis, and manipulable means accessible at an operator's station on the earthmoving machine for engaging or releasing the locking means from the boom and swing post.

2. A locking means according to claim 1, in which:

the lever means is bifurcated to provide arm portions at the one side of its fulcrum and positioned to straddle the boom when the latter is in a fully raised position, the ends of the arm portions being provided with hooks engageable with pins projecting laterally from the sides of the boom in a direction paralleling the lever means fulcrum, the hooks and pins engageable thereby comprising a first coacting latch means for holding the boom in a fully raised position.

3. A locking means according to claim 1, in which:

the manipulable means comprises a linkage system including extendible link means extending from an operating lever at the operator's station to the lever means of the locking means, the link means being yieldably extendible to protect the linkage system if the hooks are placed in a pin engageable position before the boom is raised and the boom is subsequently raised.

4. A locking means according to claim 3, in which:

the extendible link means is pivotally coupled to the lever means in position to be in substantially vertical alignment with the vertical pivot axis about which the swing post is swingable on the support frame when the locking means is in a non-locking position.

* * * * *

UNITED STATES PATENT AND TRADEMARK OFFICE

CERTIFICATE OF CORRECTION

PATENT NO. : 4,225,282

DATED : September 30, 1980

INVENTOR(S) : Walter A. Nordstrom and Bruno Brilts, Deceased

It is certified that error appears in the above-identified patent and that said Letters Patent are hereby corrected as shown below:

Column 5, line 4, cancel "lever" and substitute --latch--;

line 11, delete "and".

Column 6, line 10, for the claim reference numeral "1" should read --2--.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*